US010774617B2

(12) United States Patent
Zhan

(10) Patent No.: US 10,774,617 B2
(45) Date of Patent: Sep. 15, 2020

(54) DOWNHOLE DRILLING SYSTEM

(71) Applicants: China Petroleum & Chemical Corporation, Beijing (CN); Sinopec Tech Houston, LLC., Houston, TX (US)

(72) Inventor: Sheng Zhan, Houston, TX (US)

(73) Assignee: CHINA PETROLEUM & CHEMICAL CORPORATION, Beijing (CN)

( * ) Notice: Subject to any disclaimer, the term of this patent is extended or adjusted under 35 U.S.C. 154(b) by 61 days.

(21) Appl. No.: 16/231,077

(22) Filed: Dec. 21, 2018

(65) Prior Publication Data

US 2020/0199972 A1 Jun. 25, 2020

(51) Int. Cl.

| | |
|---|---|
| ***E21B 36/00*** | (2006.01) |
| ***E21B 44/00*** | (2006.01) |
| ***E21B 17/16*** | (2006.01) |
| ***E21B 12/00*** | (2006.01) |

(52) U.S. Cl.
CPC ..... *E21B 36/001* (2013.01); *E21B 12/00* (2013.01); *E21B 17/16* (2013.01); *E21B 44/005* (2013.01)

(58) Field of Classification Search
CPC ..... E21B 36/001; E21B 12/00; E21B 17/16; E21B 44/005
See application file for complete search history.

(56) References Cited

U.S. PATENT DOCUMENTS

| | | | | |
|---|---|---|---|---|
| 3,496,360 | A * | 2/1970 | Dewan | G01V 5/04 250/261 |
| 5,411,105 | A * | 5/1995 | Gray | E21B 21/02 175/69 |
| 6,443,228 | B1 * | 9/2002 | Aronstam | E21B 47/01 166/250.11 |
| 2004/0112601 | A1 * | 6/2004 | Hache | F25B 39/02 166/302 |
| 2009/0229382 | A1 * | 9/2009 | Sun | E21B 25/08 73/863.11 |
| 2012/0216990 | A1 * | 8/2012 | Quintero | C09K 8/82 165/104.13 |
| 2013/0032400 | A1 * | 2/2013 | Dirksen | E21B 7/15 175/17 |
| 2017/0350241 | A1 * | 12/2017 | Shi | E21B 47/124 |
| 2019/0055817 | A1 * | 2/2019 | Zhang | E21B 47/011 |

* cited by examiner

*Primary Examiner* — Christopher J Sebesta
(74) *Attorney, Agent, or Firm* — Novick, Kim & Lee, PLLC; Allen Xue

(57) ABSTRACT

A downhole drilling system for reducing effects of overheating comprises a drill string having one or more drill pipes interconnected therebetween, a bottom hole assembly (BHA) connected to a distal end of the drill string, and a controller. The BHA comprises a drill bit disposed at an end portion of the BHA, a downhole motor to rotate the drill bit, a drill collar, in which a centrally disposed passage is formed and drilling mud is supplied to the drill bit through the centrally disposed passage, a measurement instrument disposed in the drill collar to obtain drilling environmental profile and communicating with the controller, and a cooling sub disposed in or on the drill collar or the measurement instrument.

7 Claims, 3 Drawing Sheets

DOWNHOLE DRILLING SYSTEM

TECHNICAL FIELD

The present disclosure relates to a drilling system, and more particularly, to a downhole drilling apparatus used in creating boreholes in the earth's subsurface and having a cooling sub for reducing effects of overheating occurred in drilling.

BACKGROUND

In underground drilling applications, such as oil and gas or geothermal drilling, a borehole is drilled through a formation deep in the earth using a downhole drilling rig. Such boreholes are drilled or formed by a drill bit connected to a drill string of the rig.

The downhole drilling rig often includes measurement tools for gathering information regarding the formation as it is being drilled through, using techniques commonly referred to as Measurement-While-Drilling (MWD) or Logging-While-Drilling (LWD). Electronic components that operate under downhole drilling conditions, such as printed circuit board assemblies (PCBAs) in the measurement tools can be exposed to the high temperature, which often exceeds the maximum temperature rating of the normal electronic components. For example, the temperature of the formation surrounding deep wells, especially geothermal well, may exceed 200° C.

Such an overheating frequently results in failure or reduced useful life for thermally exposed electronic components. Thus, there is a need to reduce the temperature within the downhole tool in the sections containing the electronic components to within the safe operational level of the components.

Accordingly, it is desirable to have a downhole drilling system that can be maintained or controlled in a manner to reduce the effects of the overheating.

SUMMARY

The present disclosure provides systems and methods for improving the reliability and performance of the downhole drilling tools by reducing effects of overheating.

According to one embodiment of the present disclosure, a downhole drilling system for reducing effects of overheating is provided. The downhole drilling system comprises a drill string having one or more drill pipes interconnected therebetween, a bottom hole assembly (BHA) connected to a distal end of the drill string, and a controller. The BHA comprises a drill bit disposed at an end portion of the BHA, a downhole motor to rotate the drill bit, a drill collar in which a centrally disposed passage is formed and drilling mud is supplied to the drill bit through the centrally disposed passage, a measurement instrument disposed in the drill collar to obtain drilling environmental profile and communicating with the controller, and a cooling sub disposed in or on the drill collar or the measurement instrument.

In one aspect of this embodiment, the cooling sub has one or more tanks or reservoirs containing a cooling agent. Each of the tanks has a cylindrical shape or an annular shape. The cooling agent can be liquid nitrogen or dry ice (i.e., solid carbon dioxide). In this aspect, the cooling sub has a temperature sensor, and the cooling agent is released from the each of the tanks when the temperature sensor detects a temperature of the tool reach a preset temperature. In some aspects, a releasing rate of the cooling agent or a remaining volume of the cooling agent is further controlled by the controller.

In another aspect of this embodiment, the downhole drilling system further comprises a plurality of cooling shuttles carrying a cooling agent, and the plurality of cooling shuttle is transferred to the drilling bit by the drilling mud. In this aspect, the plurality of cooling shuttles is made of a dissolvable material, such as epoxy or silicone. Each of the cooling shuttles has a temperature sensor, and the cooling agent is released from each of the cooling shuttles when the temperature sensor detects a temperature that reaches a preset value.

In still another aspect of this embodiment, the drill pipe has one or more cooling channels formed therein, and a cooling agent flows through the one or more cooling channels. In this aspect, the cooling agent can be any suitable medium, e.g., water.

BRIEF DESCRIPTION OF THE DRAWINGS

The teachings of the present disclosure can be more readily understood by considering the following detailed description in conjunction with the accompanying drawings.

DETAILED DESCRIPTION

Figure 1:
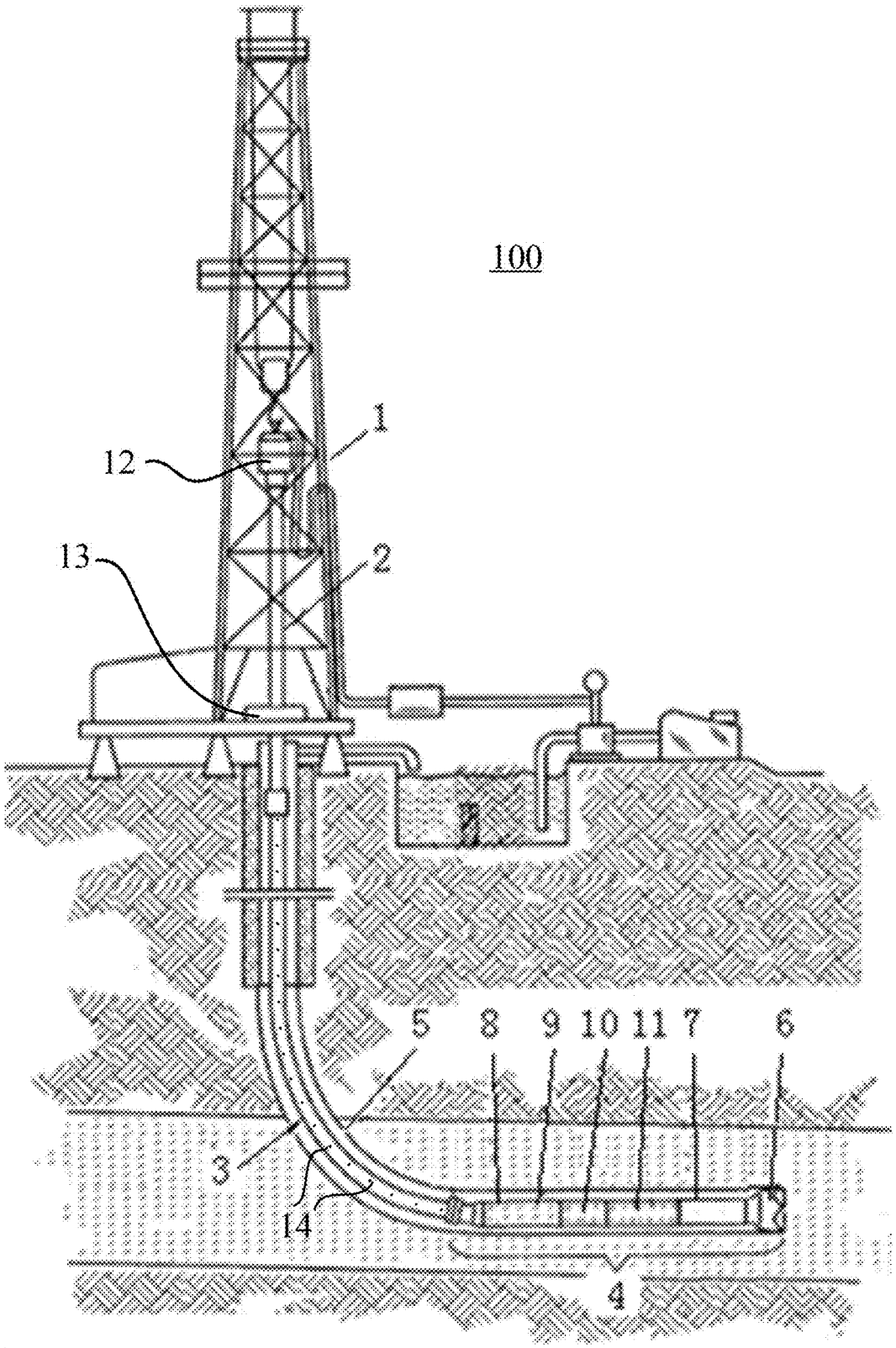
FIG. 1 is a schematic view illustrating a downhole drilling system according to one embodiment of the present disclosure.

Reference will now be made in detail to embodiments of the present disclosure, examples of which are illustrated in the accompanying drawings. It is noted that wherever practicable, similar or like reference numbers may be used in the drawings and may indicate similar or like elements.

The drawings depict embodiments of the present disclosure for purposes of illustration only. One skilled in the art would readily recognize from the following description that alternative embodiments exist without departing from the general principles of the present disclosure.

FIG. 1 is a schematic view illustrating a downhole drilling system according to one embodiment of the present disclosure.

Referring to FIG. 1, the downhole drilling system 100 has a derrick 1 on the earth surface. A kelly drive 2 delivers a drill string 3 into a borehole 5. The drill string 3 is comprised of a plurality of drill pipes that are interconnected between them. A lower part of the drill string 3 is a bottom hole assembly (BHA) 4, which includes a drill collar 8 with an MWD tool 9 installed therein, an LWD tool 10, a downhole motor 11, a measurement sub 7, and a drill bit 6. The drill bit 6 breaks up the earth formation in the borehole 5, and the downhole motor 11 having a stator and a rotor that rotate the drill bit 6. During a drilling operation, the downhole drilling system 100 may operate in a rotary mode, in which the drill string 3 is rotated from the surface either by a rotary table 13 or a top drive 12 (or a swivel). The downhole drilling system 100 may also operate in a sliding mode, in which the drill string 3 is not rotated from the surface but is driven by the downhole motor 11 rotating the drill bit 6. Drilling mud is pumped from the earth surface through a centrally disposed passage formed within the drill string 3 down to the drill bit 6, and injected from the drill bit 6. After exiting the drill bit 6, the drilling mud flows up through an annulus passage formed between the drill string 3 and a wall of the borehole 5 for returning to the surface, which refers to the "circulation" of mud. During this circulation, the drilling mud carries cuttings up from the borehole 5 to the surface.

The drill collar 8, which provides weight on the drill bit 6, has a package of measurement instruments including the MWD tool 9 for measuring inclination, azimuth, well trajectory, etc. Also included in the drill collar 8 or at other locations in the drill string are the LWD tools 10 such as a neutron-porosity measurement tool and a density measurement tool, which are used to determined formation properties such as porosity and density. Those tools are electrically or wirelessly coupled together, powered by a battery pack or a power generator driven by the drilling mud. All information gathered is transmitted to the surface via a mud pulse telemetry system or through electromagnetic transmission.

The measurement sub 7 is disposed between the downhole motor 11 and drill bit 6, measuring formation resistivity, gamma ray, and the well trajectory. The data is transmitted through the cable embedded in the downhole motor 11 to MWD or other communication devices. The downhole motor 11 is connected to a bent housing that is adjustable at the surface from 1° to 3°, preferably up to 4°. Due to the slight bend in the bent housing, the drill bit 6 can drill a curved trajectory.

Although FIG. 1 shows as an example that the LWD tool and the measurement sub are located separately from the drill collar 8, in one embodiment of this disclosure, those tools may be installed within the drill collar 8, which has a longer size for accommodating the tools together, for protecting them from heat or vibrations. Since the drill collar 8 is connected to the drill string 3, the centrally disposed passage, extending from the drill string 3, is also formed within the drill collar 8, and the drilling mud is supplied to the drill bit through this passage. A cooling sub 14 (see FIG. 2) is disposed on a surface of the drill collar 8 or in a measurement tool.

Figure 2:
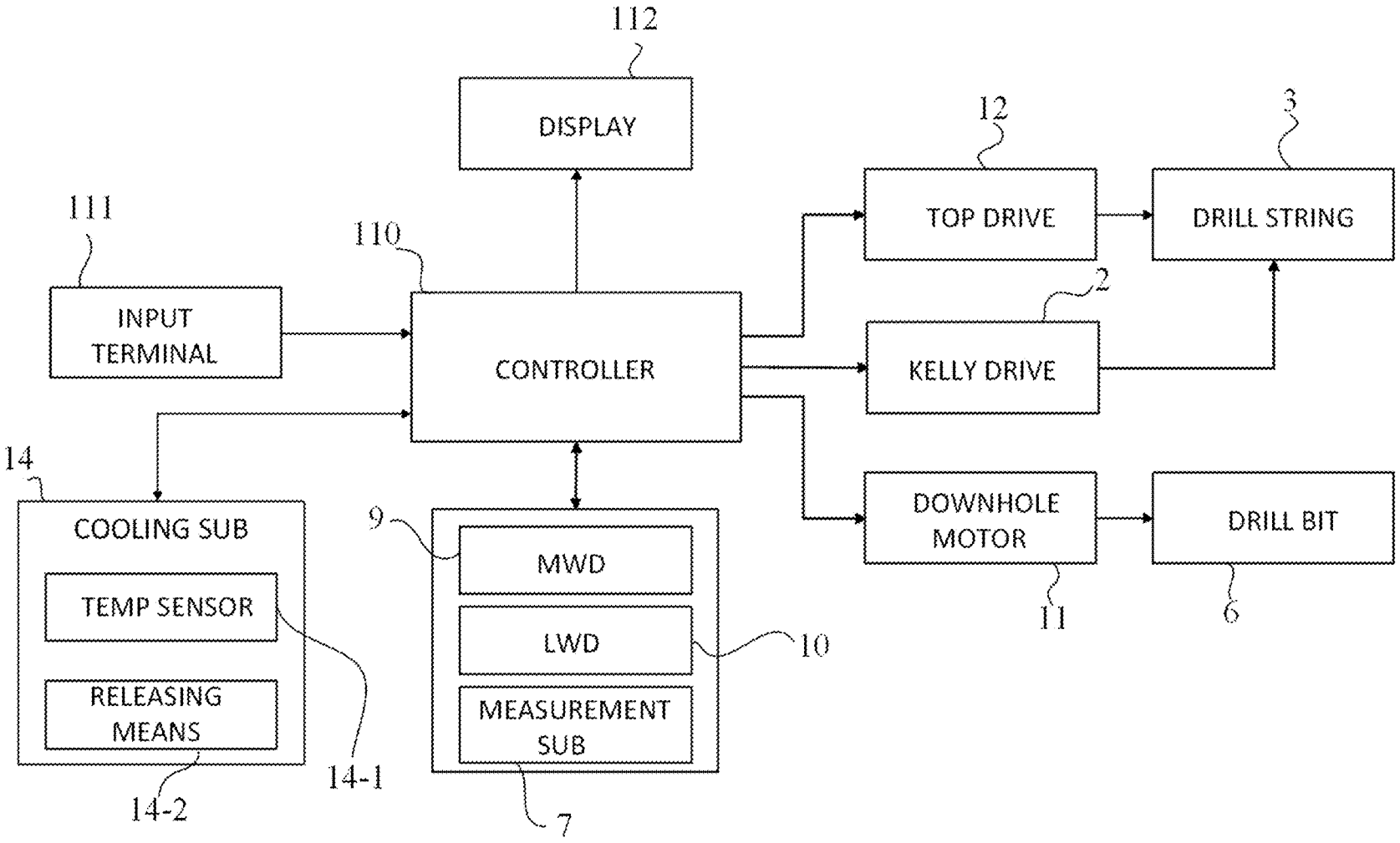
FIG. 2 is a schematic diagram illustrating a system for controlling the downhole drilling system according to one embodiment of the present disclosure.
Figure 3B:
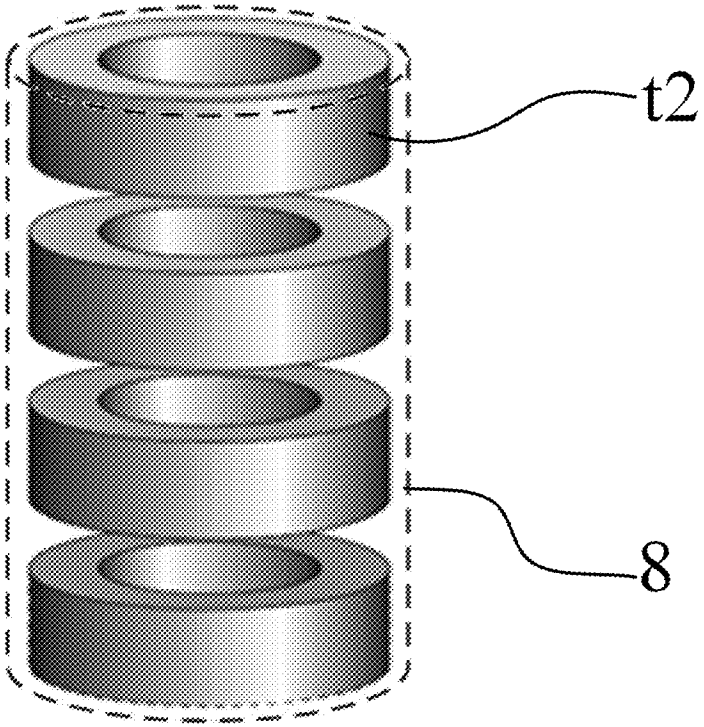
FIG. 3B shows the cooling sub according to another embodiment of the present disclosure.
Figure 3A:
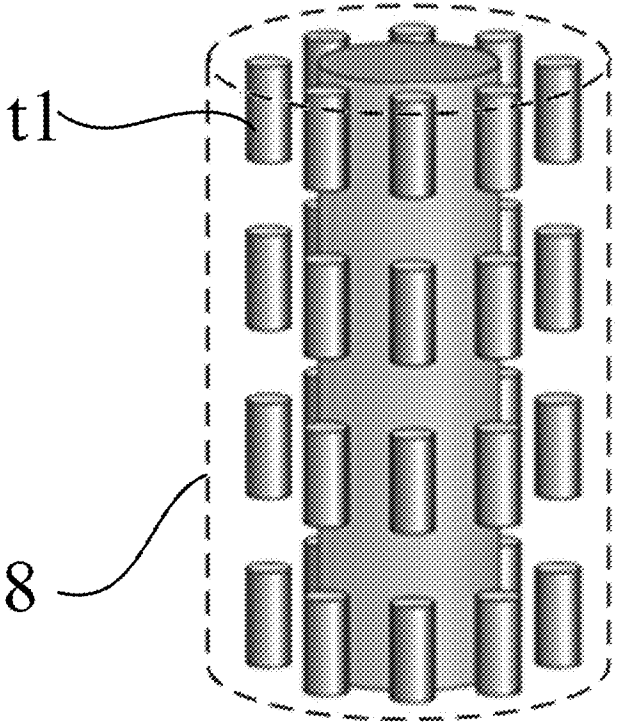
FIG. 3A shows a cooling sub in the downhole drilling system according to one embodiment of the present disclosure.

FIG. 2 is a schematic diagram illustrating a system for controlling the downhole drilling system according to one embodiment of the present disclosure. FIG. 3A shows a cooling sub in the downhole drilling system according to one embodiment of the present disclosure, and FIG. 3B shows the cooling sub according to another embodiment of the present disclosure.

Referring to FIG. 2, the downhole drilling system 100 may further include a controller 110 which controls the downhole drilling system 100 based on a drilling environmental profile including drilling parameters such as vibrations and temperature.

Through data acquisition technologies according to this embodiment, the drilling environmental profile is captured by the sensor modules in the measurement instrument, including MWD tool, LWD tool, and the cooling sub. Such drilling environmental profile may be shown on a display 112. Based on analyzed and calculated results from the environmental profile, the operator can give instructions via an input terminal 111 to control operational parts, such as the top drive 12, the kelly drive 2, the downhole motor 11, and the cooling sub 14 of the downhole drilling system 100 in order to reduce negative impacts on the system due to the vibrations or overheating. Such control also can be automatically conducted by the controller 110 without the operator's intervention. In a preferred embodiment, the real time measurements are transmitted to the controller 110 via a wireless communication protocol.

In one embodiment, the cooling sub 14 is collar based or probe based depending on the size of the instrument tool. The collar based cooling sub is the sub installed on a surface of the collar, and the probe based cooling sub is the sub installed in the housing of the sensor module (i.e. probe). It is preferable to use the collar based cooling sub when the tool size is 4¾ inch and above. For the tool having 4¾ inch below size, it is preferred to use the probe based cooling sub, especially for the small hole size and extreme high temperature well (e.g., a temperature of 175° C. and higher).

For the collar based cooling sub, the structure of the cooling sub 14 may be either cylinder cell tank style or annular cell tank style, as illustrated in FIG. 3A and FIG. 3B, respectively. In the cylinder cell tank style of FIG. 3A, the cooling sub 14 includes a plurality of cylindrical cell tanks t1 containing cooling agent, and the plurality of the cylindrical cell tanks t1 are installed around the outer or inner surface of the drill collar 8 at a regular interval in both vertical and horizontal directions. In the annular cell tank style of FIG. 3B, the cooling sub 14 includes a plurality of annular cell tanks t2 containing cooling agent, and the plurality of the annular cell tanks t2 are installed around the outer or inner surface of the drill collar 8 at a regular interval in a vertical direction. For the probe based, due to the size limitation, it can be only one tank inside of the probe. These tanks t1 and t2 can be either permanently installed inside of the cooling sub 14 or be removably installed in the cooling sub. For the removable tank, it should be designed for meeting the requirements of US Transportation Administration for the transportable container. The content of the cooling agent in the tank could be the liquid nitrogen or dry ice.

The controlling method of the cooling sub 14 may vary. In the simplified control, as shown in FIG. 2, the cooling sub 14 has a temperature sensor 14-1 that detects the local temperature. When the local temperature reaches or exceeds a preset temperature, the controller 110 sends a command to the cooling tank. Upon receiving the command, the cooling sub 14 releases the cooling agent from the cooling tank by using a releasing means 14-2, such as a solenoid valve. For example, the cooling sub 14 may release the cooling agent by opening a port or a valve in the cooling tank in response to the release command from the controller 110. In a more complex control scheme, the cooling sub 14 may further include its own microcontroller unit and power supply units along with the temperature sensors. With the downhole communication protocol, the release rate of the cooling agent and the remaining volume of the cooling agent may be further controlled by the downlink or uplink command from the main controller 110 on the surface.

In a further embodiment, the downhole drilling system includes a plurality of cooling shuttles (14 in FIG. 1) carrying the cooling agent. The cooling shuttle is put into the drilling mud at the surface (e.g., in the mud pond), and is carried downhole by the mud flow. In one embodiment, the cooling shuttle is made of a dissolvable material, such as epoxy or silicone, which dissolves at a certain temperature. Thus, when the cooling shuttles arrive at a thermally stressed region downhole, typically near the BHA, the material of the cooling shuttles starts to dissolve so as to release the cooling agent contained inside the shuttles into the mud. As a result, the released cooling agent reduces the temperature of the drilling mud locally, which in turn reduces the temperature of the downhole tools in that area. In another embodiment, each cooling shuttle has a temperature sensor, and when the detected local temperature exceeds a preset value, the controller may trigger the release command of the cooling shuttle. Upon receiving the release command, the cooling shuttle releases the cooling agent using a releasing means, for example, a solenoid valve. After dissolving, the material of the shuttle may be treated as the drilling debris and thus it will not block the circulation of the mud. The content of the cooling agent in the shuttle also could be the liquid nitrogen or dry ice.

According to one embodiment, a connection part or connector of the drill pipe, in which a gundrill (or a boredrill) is accommodated, may be designed to support a cooling agent. To reduce the cost, the cooling agent can be cooling water or other affordable liquids, such as oil, or gas, which may be pumped through the bores (or tubes/channels/outlets) formed in each drill pipe. This cooling system may provide continuous cooling solution through the inner bores in the pipe, and the number of the cooling bores may vary depending on the structure of the pipe and applications. For the low pressure drilling application, the number of the bores could be increased. For the high pressure drilling application, the number of the bores need to be reduced, even to only one. This cooling system would be especially useful for the geothermal drilling applications exposed to the extremely high temperature, but may not be applicable in deep drilling applications. However, it would provide sustainable cooling for the whole drilling process, regardless whether the circulation pump is on or off.

Embodiments of the present disclosure have been described in detail. Other embodiments will become apparent to those skilled in the art from consideration and practice of the present disclosure. Accordingly, it is intended that the specification and the drawings be considered as exemplary and explanatory only, with the true scope of the present disclosure being set forth in the following claims.

What is claimed is:

1. A downhole drilling system for reducing effects of overheating, comprising:

a drill string having one or more drill pipes interconnected therebetween;

a bottom hole assembly (BHA) connected to a distal end of the drill string;

a controller;

a borehole wherein the drilling string is disposed in;

a drilling mud that circulates between the borehole and an earth surface;

a plurality of cooling shuttles, each configured to be carried downhole by the drilling mud flow, wherein the BHA comprises:

a drill bit disposed at an end portion of the BHA, a downhole motor to rotate the drill bit, a drill collar, in which a centrally disposed passage is formed and drilling mud is supplied to the drill bit through the centrally disposed passage, a measurement instrument disposed in the drill collar to obtain drilling environmental profile and communicating with the controller, and a cooling sub disposed in or on the drill collar or the measurement instrument;

wherein each cooling shuttle has a container made of a dissolvable material and contains a first cooling agent, wherein the dissolvable material is configured to dissolve downhole and to release the first cooling agent.

2. The downhole drilling system of claim 1, wherein the cooling sub has one or more tanks containing second cooling agent.

3. The downhole drilling system of claim 2, wherein each of the one or more tanks is in a cylindrical shape or in an annular shape.

4. The downhole drilling system of claim 2, wherein either the first cooling agent or the second cooling agent is liquid nitrogen or dry ice.

5. The downhole drilling system of claim 2, wherein the cooling sub has a temperature sensor, and the cooling agent is released from the each of the one or more tanks when the temperature sensor detects a temperature that exceeds a preset value.

6. The downhole drilling system of claim 1, wherein the dissolvable material is epoxy or silicone.

7. The downhole drilling system of claim 1, wherein the first cooling agent is water.

* * * * *